US007255023B1

(12) United States Patent
Heath

(10) Patent No.: US 7,255,023 B1
(45) Date of Patent: Aug. 14, 2007

(54) APPARATUS AND METHOD FOR OPENING LOCKED DOORS

(76) Inventor: Bernard Heath, 11240 Ocalla Dr., Warren, MI (US) 48089

( * ) Notice: Subject to any disclaimer, the term of this patent is extended or adjusted under 35 U.S.C. 154(b) by 0 days.

(21) Appl. No.: 11/483,449

(22) Filed: Jul. 10, 2006

Related U.S. Application Data

(60) Provisional application No. 60/794,687, filed on Apr. 25, 2006.

(51) Int. Cl.
*E05B 19/20* (2006.01)

(52) U.S. Cl. ..... 81/15.9

(58) Field of Classification Search ..... 81/15.9, 81/488, 64, 3.4; 70/465; 294/19.1
See application file for complete search history.

(56) References Cited

U.S. PATENT DOCUMENTS 4,144,778 A * 3/1979 Waring ..... 81/15.9
4,876,927 A 10/1989 Mullen
5,123,307 A 6/1992 Dyer
5,540,121 A 7/1996 Helmers
5,642,648 A * 7/1997 Wendt et al. ..... 81/15.9
6,260,455 B1 * 7/2001 Ferguson ..... 81/488
6,360,637 B1 3/2002 Weinraub
6,640,667 B1 11/2003 Pomerantz
7,004,051 B1 2/2006 Orner

* cited by examiner

*Primary Examiner*—Hadi Shakeri
(74) *Attorney, Agent, or Firm*—Christopher P. Maiorana, PC; Robert M. Miller

(57) ABSTRACT

An apparatus comprising an elongated rod and a strap. The elongated rod is generally adapted for sliding under a bottom of a locked door. The elongated rod generally includes a main section, a curved section, a handle end and an actuator end. The handle end, the curved section and the actuator end generally extend away from the main section in the same direction such that the handle end, the curve section, the main section, and the actuator end define a plane. The strap is generally adapted for engagement with an opening mechanism of the locked door. A first end of the strap is attached to the actuator end and a second end of the strap is attached to the main section by a first connection device. The first connection device is generally adapted to slide along the main section of the elongated rod.

20 Claims, 6 Drawing Sheets

APPARATUS AND METHOD FOR OPENING LOCKED DOORS

This application claims the benefit of U.S. Provisional Application No. 60/794,687, filed Apr. 25, 2006 and is hereby incorporated by reference in its entirety.

FIELD OF THE INVENTION

The present invention relates to locksmithing services generally and, more particularly, to an apparatus and/or method for opening locked doors.

BACKGROUND OF THE INVENTION

A person can find themselves locked out of their home or office and unable to enter. For example, keys can be locked inside, a key can be broken off in the lock or the keyway of the lock can be glued through vandalism. Police may need to gain access through a locked door in order to help in an emergency or prevent a crime. Locksmiths can drill a hole into the lock case to release the locking mechanism or drill out the cylinder. However, drilling a hole in a lock case to release the locking mechanism causes damage to the unit and often requires replacement of the lock. Similarly, drilling out the cylinder requires inserting and re-pinning a new cylinder. Another method for pin and tumbler locks is to use a pick set to pick the lock. However, pick sets are illegal in most states, except when used by registered locksmiths. High security locks can be designed to prevent picking.

It would be desirable to have an apparatus and/or method for opening locked doors without causing damage to the door or to the lock and without the time consuming, or futile, process of picking the lock.

SUMMARY OF THE INVENTION

The present invention concerns an apparatus comprising an elongated rod and a strap. The elongated rod is generally adapted for sliding under a bottom of a locked door. The elongated rod generally includes a main section, a curved section, a handle end and an actuator end. The handle end, the curved section and the actuator end generally extend away from the main section in the same direction such that the handle end, the curve section, the main section, and the actuator end define a plane. The strap is generally adapted for engagement with an opening mechanism of the locked door. A first end of the strap is attached to the actuator end and a second end of the strap is attached to the main section by a first connection device. The first connection device is generally adapted to slide along the main section of the elongated rod.

The objects, features and advantages of the present invention include providing an apparatus and/or method for opening locked doors that may (i) open knob and/or lever type lock sets, (ii) open locked doors without causing damage to the lock and/or door, (iii) operate on doors with limited space, (iv) wrap a material around a knob to maximize knob rotation, (v) provide one-handed operation and/or (vi) be simple to operate.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention generally provides an apparatus for opening locked doors by turning an inside knob of the locked door. The present invention further provides a method for using the apparatus for opening locked doors. The present invention generally provides an apparatus that may open lock doors having either a knob type or a lever type handle. The present invention may further provide a set of tools (or kit) comprising (i) a tool for opening doors having either a knob type or a lever type handle and (ii) a tool customized for opening locked doors with lever type handles.

Figure 1:
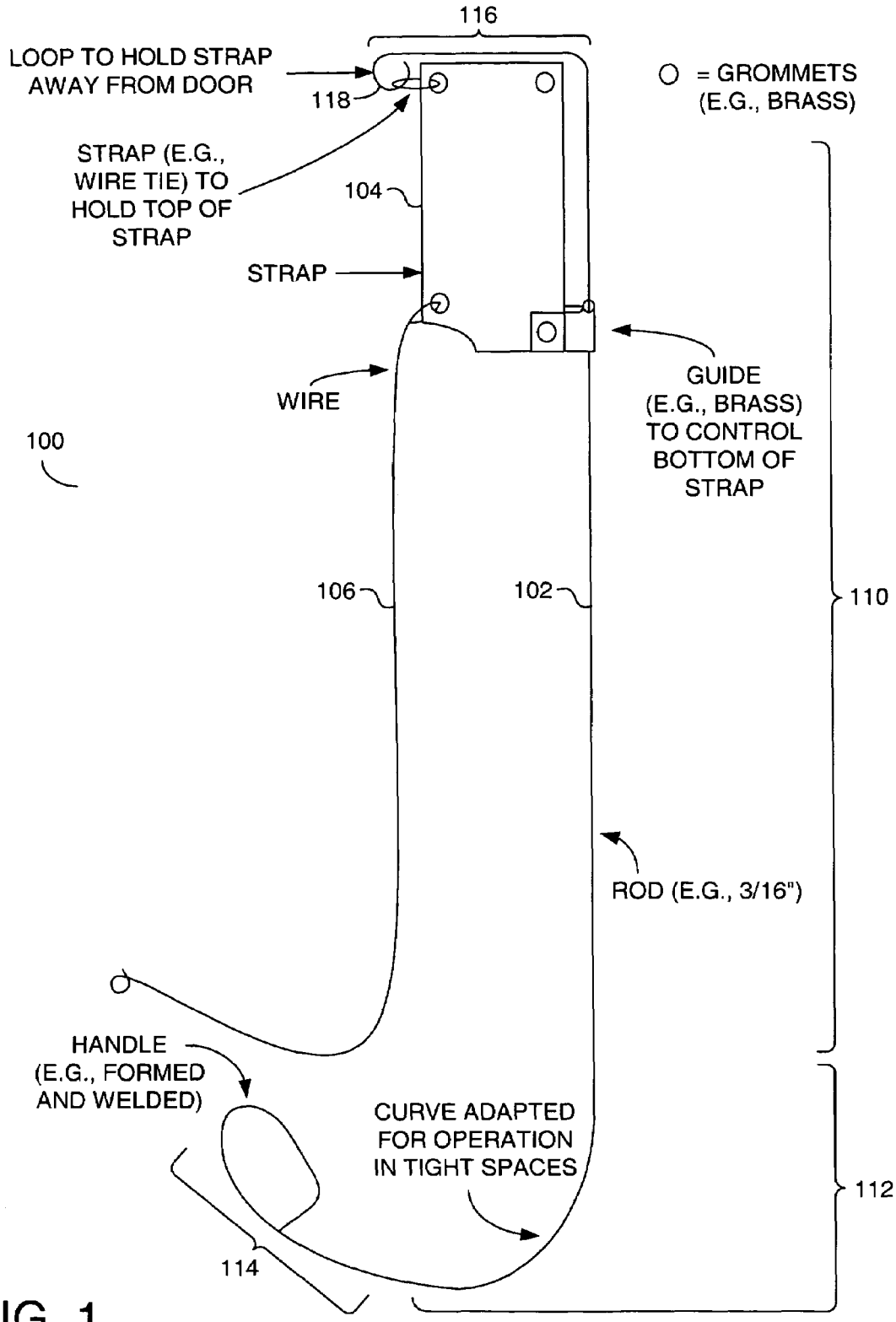
FIG. 1 is a diagram illustrating a tool in accordance with an embodiment of the present invention.

Referring to FIG. 1, a diagram is shown illustrating a tool 100 in accordance with an embodiment of the present invention. The tool 100 may comprise an elongated rod 102, a strap 104 and a pullcord 106. In one example, the elongated rod 102 may be formed from three-sixteenth inch steel rod stock. However, other sizes and materials may be used accordingly to meet the design criteria of a particular implementation. In one example, the elongated rod 102 may be powder coated for aesthetics. The elongated rod 102 generally has an overall length greater than a vertical distance between a bottom of the locked door and the door opening mechanism (e.g., knob, lever, etc.).

The elongated rod 102 may be adapted to be inserted under a locked door and raised up to make contact with the inside knob of the door allowing rotation of the knob from the outside of the door to open the locked door. The elongated rod 102 generally includes a main section 110, a curved section 112, a handle end 114 and an actuator end 116. The handle end 114 may be formed by bending the rod material to form a loop and, for example, welding the loop closed. The handle end 114 is generally disposed at one end of the curved section 112. A second end of the curved section 112 connects to a first end of the main section 110. A second end of the main section 110 generally transitions into the actuator end 116. In one example, the actuator end 116 of the rod may be formed by bending a portion of the rod material perpendicular to the main section 110 and forming a loop 118 at the end of the perpendicular portion.

The strap 104 may be attached to the main section 110 and the actuator end 116 of the elongated rod. In one example, the strap 104 may be implemented using a flexible material having a high coefficient of friction (e.g., a textured rubber material, etc.). For example, the strap 104 may be formed using one-sixteenth inch red textured rubber gasket material available through a hardware store. However, any material that may provide a relatively high-friction surface and limited deformation when pressed against an object may be used.

The strap 104 may be implemented as a generally rectangular piece of material. In one example, the strap 104 may have one corner removed. In one example, the strap 104 may include four attachment locations (or points). In one example, the attachment locations may be formed with grommets inserted through the material. In one example, the grommets may be metal (e.g., aluminum, brass, etc.). However, other materials may be used accordingly to meet the design criteria of a particular implementation.

The strap 104 may have a first upper corner, a second upper corner, a first lower corner and a second lower corner. In one example, a distance between the first upper corner and the first lower corner may be shorter than a distance between the second upper corner and the second lower corner. The first upper corner of the strap 104 may be attached to a loop portion 118 of the actuator end 116 using a first connection device. The first connection device generally provides a rigid connection between the strap 104 and the actuator end 116. In one example, the first connection device may be implemented with a nylon wire tie. However, other connection devices may be implemented accordingly to meet the design criteria of a particular implementation.

The second lower corner of the strap 104 may be connected to the main section 110 using a second connection device. The second connection device generally provides a rigid connection between the strap 104 and the main section 110. In one example, the second connection device may comprise a metal (e.g., brass, aluminum, steel, etc.) or plastic (e.g., nylon, etc.) guide strap. The guide strap may be adapted to slide along the main section 110 of the elongated rod 102.

The pullcord 106 may be attached to the first lower corner of the strap 104. The pullcord 106 may be implemented using wire, string, cord, twine, or other string-like material. The attachment point in the first lower corner of the strap 104 is generally vertically displaced from a line drawn perpendicularly to the main section 110 of the elongated rod 102 and through the attachment point in the second lower corner. Therefore, the point of attachment of the pull cord to the first lower corner is at a position higher than the point of attachment of the second lower corner of the strap 104 to the main section 110 of the elongated rod 102.

The second upper corner of the strap 104 may be, in one example, left disconnected from the actuator end 116 of the elongated rod 102. In another example, the second upper corner of the strap 104 may be connected via a third connection device to either the actuator end 116 or the main section 110 of the elongated rod 102.

Figure 2:
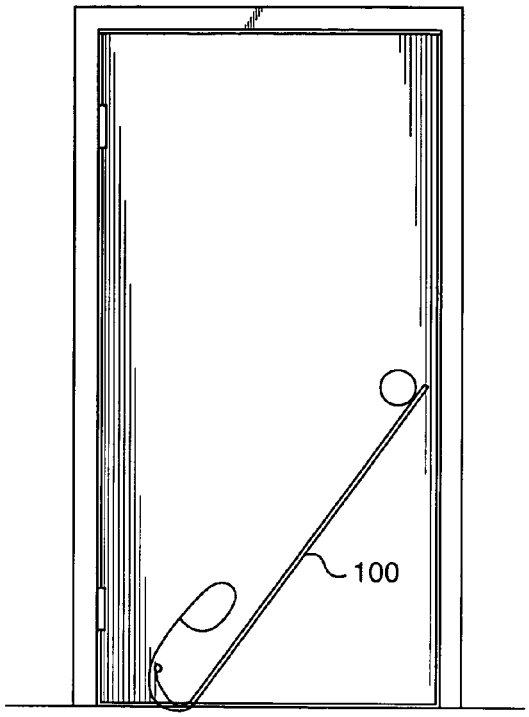
FIG. 2 is a diagram illustrating the tool of FIG. 1 in a position relative to a lockset of a door.

Referring to FIG. 2, a diagram is shown illustrating the overall length of the tool 100 relative to the distance between the bottom of a locked door and the door opening mechanism. The tool 100 is shown in front of the door with the handle end 114 toward a hinge side of the door and the actuator end 116 in contact with the door opening mechanism.

Figure 3:
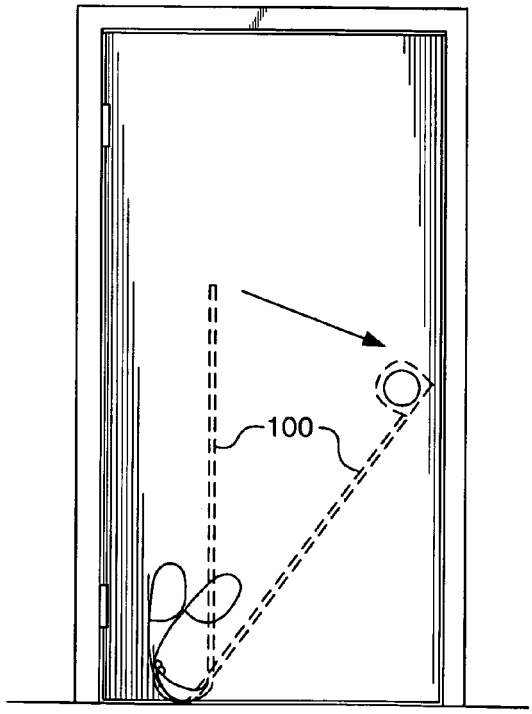
FIG. 3 is a diagram illustrating an example operation of the tool of FIG. 1.

Referring to FIG. 3, a diagram is shown illustrating an example operation of the tool 100. During operation, the main section 110 and the actuator end 116 are behind the locked door, the curved section 112 is passing under the door and the handle end 114 and an end of the pullcord 106 are on the front side of the door being manipulator by the person trying to open the door. In general, the actuator end 116 of the tool 100 is moved from a vertical position toward the door opening mechanism until the strap 104 engages the door opening mechanism. In one example, the handle end 114 may be moved toward the hinge side of the door while the actuator end 116 is moved toward the door opening mechanism.

Figure 4:
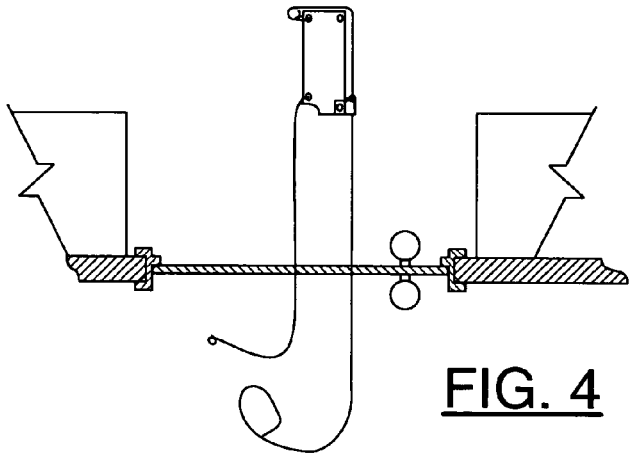
FIG. 4 is a diagram illustrating the tool of FIG. 1 under a door.
Figure 5:
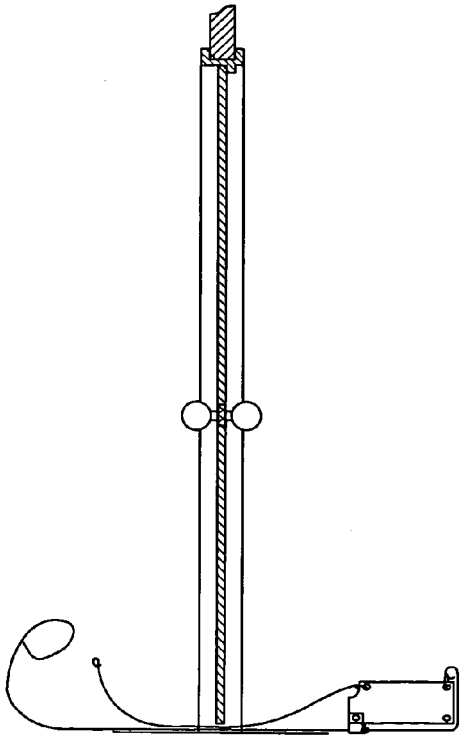
FIG. 5 is a diagram illustrating the tool of FIG. 1 rotated prior to being lifted.
Figure 6:
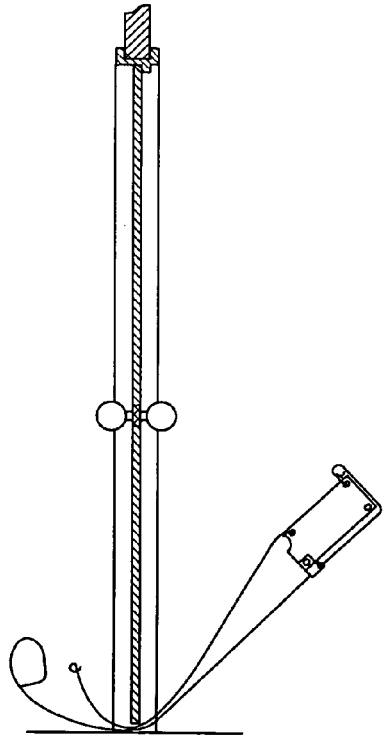
FIG. 6 is a diagram illustrating the tool of FIG. 1 being lifted toward the door.
Figure 7:
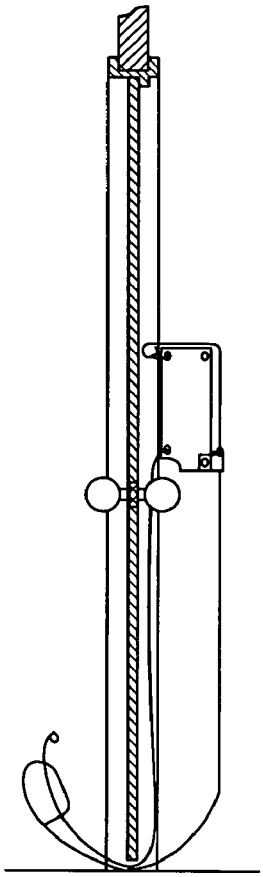
FIG. 7 is a diagram illustrating the tool of FIG. 1 lifted to a vertical position and in contact with the door.

Referring to FIGS. 4-8, diagrams are shown illustrating various points in an example operation of the tool 100. The curved section 112 of the elongated rod 102 is generally adapted to allow operation of the tool 100 on doors having limited space behind them. For example, the tool 100 may be slid under the door to a point where the strap 104 is completely on the rear side of the door (FIG. 4). The handle portion 114 may then be rotated up approximately 90 degrees from the floor also raising the strap 104 and actuator end 116 (FIG. 5). The tool 100 may then be rotated upwards to bring the actuator end 116 of the elongated rod 102 into contact with the back side of the door (FIGS. 6 and 7). In general, the apparatus is slid beneath a center portion of the door and raised up into position.

Figure 8:
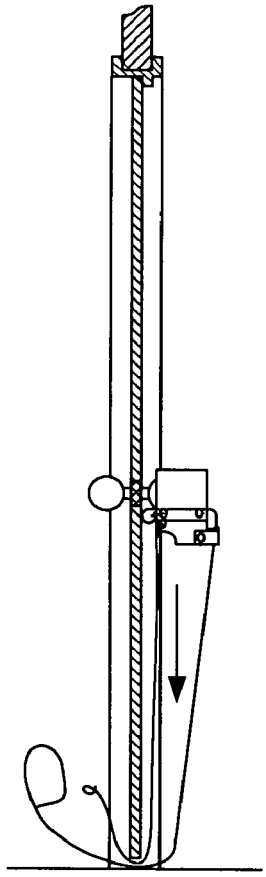
FIG. 8 is a diagram illustrating a strap of the tool of FIG. 1 wrapped on a handle of the door.

Referring to FIG. 8, a diagram is shown illustrating the strap 104 engaging the door opening mechanism. The tool 100 is generally rotated (as illustrated in FIG. 3) such that the strap 104 is brought down on top of the knob (or lever) on the rear (inside) side of the door while the handle portion 114 is slid toward the hinge side of the door. As the strap 104 comes in contact with the knob on the rear side of the door, the actuator end 116 of tool 100 is lowered such that the strap wraps around the knob (or lever). In general, the actuator end 116 may be lowered to maximize contact between the strap 104 and the knob (e.g., the actuator end 116 is moved down between the knob and the jamb of the door). When the tool 100 is in position, the pullcord 106 attached to the first lower corner of the strap 104 may be pulled causing the knob or lever to rotate and open the locked door.

The loop 118 of the actuator end 116 is generally adapted such that the strap 104 is spaced away from the back of the door (e.g., to avoid a rosette which may be behind the knob and against the face of the door). The attachments of the first upper corner and second lower corner of the strap 104 generally provide an advantage of causing the strap 104 to wrap and encase (e.g., cup around) the knob, thereby increasing turning power.

The curved section 112 of the elongated rod 102 generally provides the advantage of allowing the tool 100 to slide under the center of the door and be raised up into position in spaces that are shallow (e.g., having a depth less than the overall length of the elongated rod) and/or that may include obstructions (e.g., desks, file cabinets, etc. on either side of the door).

Figure 9:
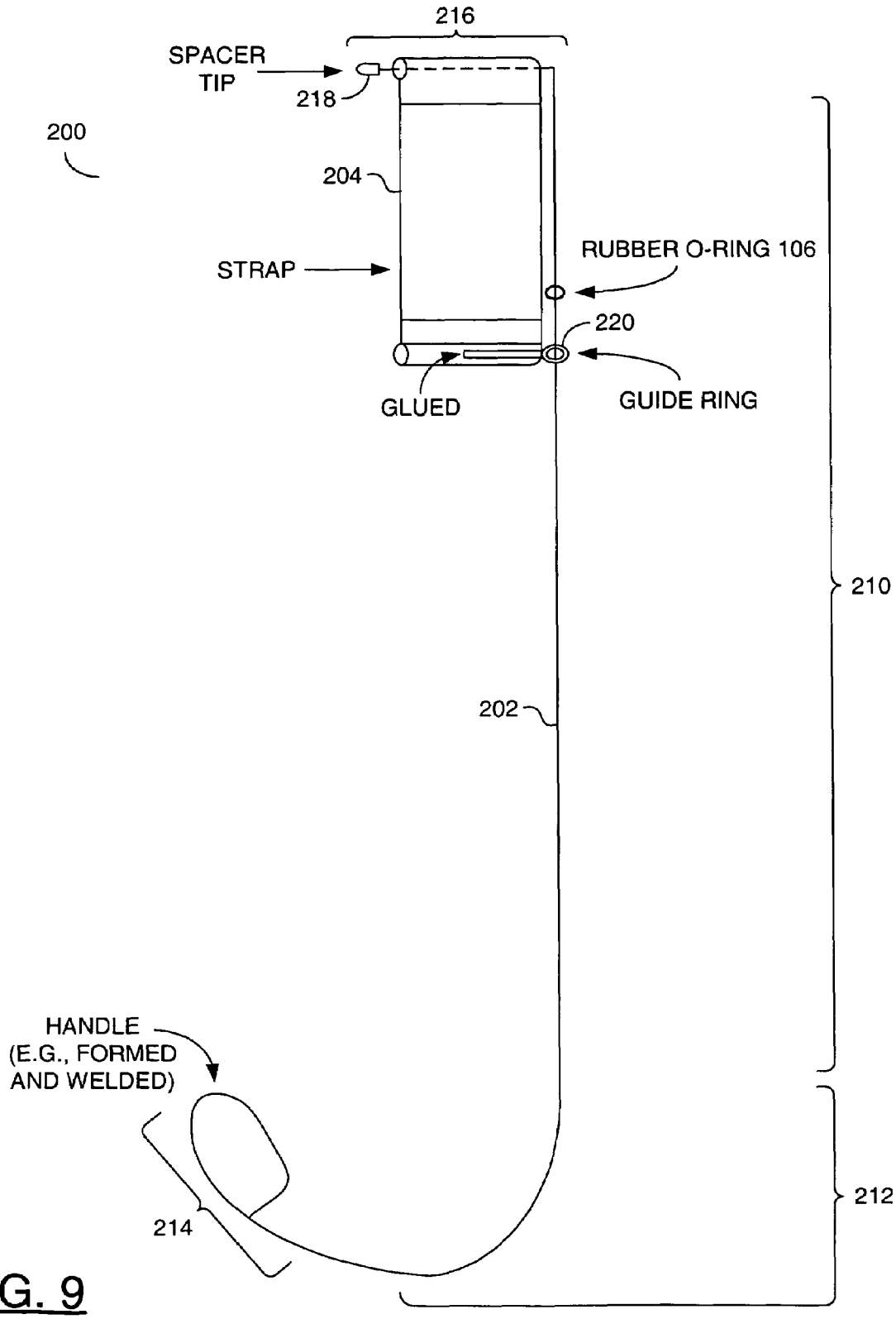
FIG. 9 is a diagram illustrating an alternative embodiment of the present invention.

Referring to FIG. 9, a diagram of a tool 200 is shown illustrating another embodiment of the present invention. The tool 200 may be used similarly to the tool 100 except that the tool 200 may allow one-handed operation. For example, the tool 200 may be operated similarly to the tool 100 as illustrated generally in FIGS. 3-8 while eliminating the pullcord 106.

The tool 200 may comprise an elongated rod 202, a strap 204 and a stopper device 206. In one example, the elongated rod 202 may be formed from three-sixteenth inch steel rod stock. However, other sizes and materials may be used accordingly to meet the design criteria of a particular implementation. The elongated rod 202 generally has an overall length greater than a vertical distance between a bottom of the locked door and the door opening mechanism (e.g., knob, lever, etc.).

The elongated rod 202 may be adapted to be inserted under a locked door and raised up to make contact with the inside knob of the door allowing rotation of the knob from the outside of the door to open the locked door. The elongated rod 202 generally includes a main section 210, a curved section 212, a handle end 214 and an actuator end 216. The handle end 214 may be formed by bending the rod material to form a loop and, for example, welding the loop closed. The handle end 214 is generally disposed at one end of the curved section 212. A second end of the curved section 212 connects to a first end of the main section 210. A second end of the main section 210 generally transitions into the actuator end 216. In one example, the actuator end 216 of the rod may be formed by bending a portion of the rod material perpendicular to the main section 210 and attaching a tip 218 at the end of the perpendicular portion. The tip 218 generally comprises a material for protecting a finish of a door. In one example, the tip 218 may be implemented by placing a soft plastic bolt cover over the end of the rod material forming the actuator end 216. In another example, the tip 218 may be formed using a plastic material (e.g., nylon, Teflon, etc.) and attached (e.g., threaded on, press fitted, etc.) to the actuator end 216.

The strap 204 may be attached to the main section 210 and the actuator end 216 of the elongated rod 202. In one example, the strap 204 may be implemented using a flexible material having a high coefficient of friction (e.g., a textured rubber material, etc.). For example, the strap 204 may be formed using one-sixteenth inch red textured rubber gasket material. However, any material that may provide a relatively high-friction surface and limited deformation when pressed against an object may be used.

The strap 204 may be implemented as a generally rectangular piece of material. In one example, a top end of the strap 204 may be wrapped around the actuator end 216 and fastened back to itself. In one example, an adhesive product (e.g., Super Bonder® 420 Instant Adhesive from Henkel Loctite Corporation, Rocky Hill, Conn.) designed to bond (weld, glue, fuse, etc.) the particular material of the strap 204 may be used to form the top end of the strap 104 into a sleeve that fits over the actuator end 216.

A lower end of the strap 204 may be connected on one side to the main section 210 using a connection device 220. In one example, the connection device may be metal (e.g., brass, aluminum, steel, etc.) or plastic (e.g., nylon, etc.). The connection device 220 may comprise a guide strap (or ring) adapted to slide along the main section 210 of the elongated rod 202. In one example, the connection device 220 may be implemented using a nylon wire tie. In one example, the lower end of the strap 204 may be glued similarly to the top end to form a sleeve via which the connection device 220 connects to the strap 204.

The stopper device 206 may be attached to the main section 210 of the elongated rod 202 between the actuator end 216 and the connection device 220. The stopper device 206 may be implemented, in one example, as a rubber o-ring. In one example, the o-ring may have an inner diameter approximately equal to or less than a diameter of the elongated rod 202. In general, the stopper device 206 is configured such that the stopper device 206 may be easily positioned along the main section 210 while providing substantial resistance to (e.g., stopping) movement of the connection device 220 past the position of the stopper device 206, along the main section 210, during operation of the tool 200.

The tool 200 is generally slid under a locked door and lifted into a vertical position in a similar manner as described above in connection with FIGS. 4-8. When the tool 200 is in a vertical position with the tip 218 against the back of the locked door, the tool 200 is generally rotated such that the strap 204 is brought down on the door opening mechanism (e.g., knob, lever, etc.). As the tool 200 is brought down on the door opening mechanism, the strap 204 wraps on the door opening mechanism and the connection device 220 slides along the main section 210 until stopped by the stopper device 206. When the connection device 220 is stopped by the stopper device 206, resistance may be felt to further lowering of the tool 200 onto the door opening mechanism. When resistance is felt to further lowering of the tool 200, the handle end 214 of the tool 200 may be moved toward the hinge side of the door to rotated the door opening mechanism and open the locked door. In general, the operation of opening the locked door with the tool 200 may be performed with one hand.

In one example, the strap 204 may be implemented having a length ranging from about twelve inches to about eighteen inches and a width ranging from about two inches to about four inches. The stopper device 206 is generally initially positioned about two inches above a lowest position of the connection device 220 along the main section 210. However, the initial position of the stopper device 206 may be varied to vary the amount of the strap 204 that wraps on the door opening mechanism. Increasing the initial distance between the stopper device 206 and the connection device 220 generally increases the amount of the strap 204 that wraps on the door opening mechanism. Increasing the amount of the strap 204 that wraps on the door opening mechanism generally increases the force applied by the tool 200 to rotate the door opening mechanism.

Figure 10:
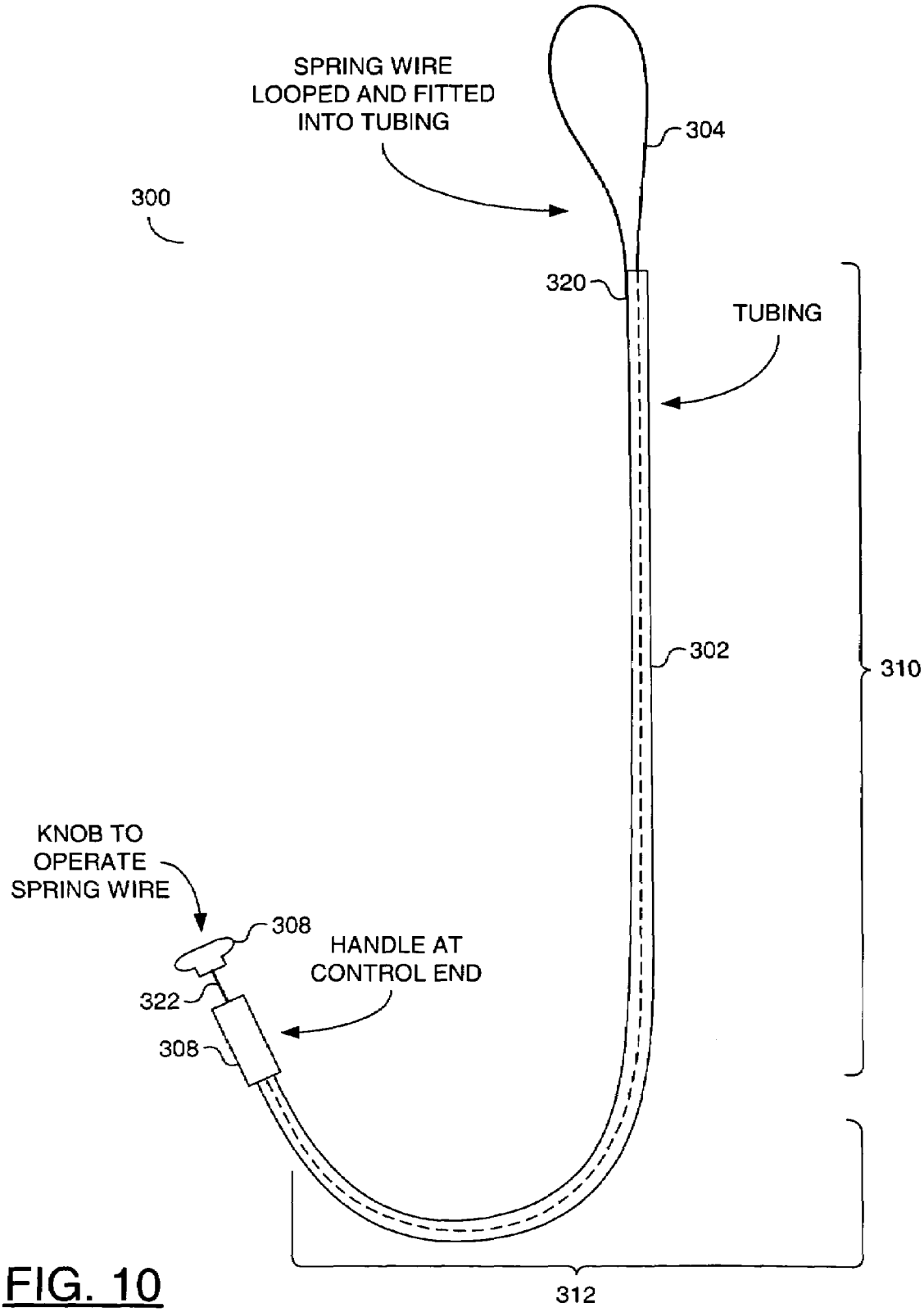
FIG. 10 is a diagram of a tool for opening lever handle type locksets.

Referring to FIG. 10, a diagram is shown illustrating a tool 300 for opening locked doors having a lever type handle. In one example, the tool 300 may comprise a tube portion 302, an actuator portion 304, a handle 306 and a knob 308. The tube portion 302 may be implemented, in one example, using one-quarter inch metal (e.g., steel, etc.) tubing. The actuator portion may be implemented, in one example, using three-sixteenth inch spring wire. In one example, a wire from and electrician's wire puller (or snake) may be used to implement the actuator portion. The handle 306 and the knob 308 may be implemented using wood, plastic, metal or other suitable material.

The tube portion 302 generally comprises a straight section 310 and a curved section 312. The curved section 312 is generally shaped to allow the tool 300 to be slid under doors and lifted to a vertical position with a minimal amount of space behind the door. The straight section 310 generally transitions into the curved section 312. The straight section 310 and the curved section 312 may be formed from a single piece of tubing. The handle 306 is generally adapted to fit over an end of the curved section 312 of the tube portion 302.

The actuator portion 304 may have a first end 320 and a second end 322. The first end 320 may be attached to an outside surface of the straight section 310 of the tube portion 302. In one example, the first end may be bonded (or welded) to the tube portion 302. The second end 322 may be passed through the tube portion 302 forming a loop at an end of the straight section 310 where the first end is attached and exiting the tube portion 302 at an end of the curved section 312 and passing through the handle 306. The handle 306 may be attached to the end of the curved section 312. The knob 308 may be attached to the second end 322 of the actuator portion 304. In one example, the tool 300 may be covered with a material for protecting finished surfaces of the door and/or aesthetic considerations. In one example, the tool 300 may be covered with heat shrink tubing.

In general, the tool 300 may be slid under the locked door and manipulated to position the loop of the actuator portion 304 over the lever type handle similarly to the process described above in connection with FIGS. 3-8. When the loop of the actuator portion 304 is over the lever type handle, the knob 308 may be pulled while holding the tool 300 in position. Pulling the knob 308 generally causes the loop of the actuator portion 304 to become smaller, thus pulling on the lever type handle.

The present invention generally provides tools that may be used to open locked doors that have damaged key cylinders and/or locks that have pick resistant cylinders. The tools implemented in accordance with the present invention may be used to open locked doors having locks that meet fire codes specifying that commercial locks open with a single turn. The tools implemented in accordance with the present invention may be adapted to slide under a locked door using a small gap between the door and the floor that may result from barrier free access specifications. The present invention may provide a kit comprising a tool capable of opening knob and/or lever type doors (e.g., the tools 100 and 200 above) and a tool adapted to opening lever type doors (e.g., the tool 300).

While the invention has been particularly shown and described with reference to the preferred embodiments thereof, it will be understood by those skilled in the art that various changes in form and details may be made without departing from the spirit and scope of the invention.

The invention claimed is:

1. An apparatus comprising:

an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane; and a strap adapted for engagement with an opening mechanism of the locked door, wherein a first end of said strap is attached to said actuator end and a second end of said strap is attached to said main section by a first connection device adapted to slide along said main section of the elongated rod.

2. The apparatus according to claim 1, further comprising:

a tip disposed at an end of said actuator end of the elongated rod, wherein said tip is adapted to minimize damage to said door.

3. The apparatus according to claim 1, wherein said strap comprises a sleeve adapted to attach said strap to said actuator end.

4. The apparatus according to claim 3, wherein said sleeve is formed by wrapping said strap around said actuator end and glueing said strap to itself.

5. The apparatus according to claim 1, further comprising:

a stopper device disposed on said main section of the elongated rod between said actuator end and said first connection device.

6. The apparatus according to claim 5, wherein said stopper device comprises a rubber o-ring.

7. The apparatus according to claim 1, wherein said actuator end comprises a loop disposed at an end opposite from said main section of the elongated rod.

8. The apparatus according to claim 7, wherein said strap is attached to said loop by a second connection device.

9. The apparatus according to claim 8, wherein said second connection device comprises a nylon tie.

10. The apparatus according to claim 8, further comprising:

a pullcord attached to said strap at a position below said second connection device and opposite said first connection device, said pullcord having a length which is approximately equal to the length of the elongated rod, wherein said actuator end of said elongated rod and said strap are inserted under said locked door and said handle is used to rotate said elongated rod and strap to engage said opening mechanism, and wherein the pullcord is pulled to rotate said opening mechanism in a direction causing said opening mechanism to open said locked door.

11. The apparatus according to claim 1, wherein the main section and curved section together have an overall length greater than the vertical distance between said opening mechanism of the locked door and a floor.

12. The apparatus according to claim 1, wherein said strap comprises a rectangle of textured rubber gasket material.

13. The apparatus according to claim 1, wherein said apparatus is operable to open a locked door with one hand.

14. The apparatus according to claim 1, further comprising:

a handle for manipulating and rotating the elongated rod while the elongated rod is under the door, said handle disposed at the handle end of the elongated rod.

15. A method for rotating a doorknob of a locked door, comprising the steps of:

sliding an apparatus according to claim 1 under a bottom of a locked door;

rotating the apparatus such that the actuator end and the strap are substantially vertical to a floor under said locked door;

rotating the apparatus such that the actuator end and the strap are raised substantially vertical to the floor under said locked door and in contact with a back of said locked door;

rotating the apparatus such that the strap is wrapped on an opening mechanism of said locked door from above, the actuator end of the elongated rod is between the opening mechanism and a jamb of said locked door and the handle end of said elongated rod is positioned toward a hinge edge of said locked door; and manipulating the apparatus according to claim 1 to turn the opening mechanism and open said locked door.

16. The method according to claim 15, wherein the step of manipulating the apparatus comprises moving the handle end toward the hinge edge of the locked door.

17. The method according to claim 15, wherein said apparatus is operable with one hand.

18. The method according to claim 15, wherein said apparatus further comprises a pullcord and the step of manipulating the apparatus comprises manipulating the handle end of the apparatus and the pullcord to turn the opening mechanism and open said locked door.

19. A tool kit for use by locksmiths to open locked doors, said tool kit comprising:

a first tool comprising (i) an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane and (ii) a strap adapted for engagement with an opening mechanism, wherein a first end of said strap is attached to said actuator end and a second end of said strap is attached to said main section by a first connection device adapted to slide along said main section of the elongated rod; and A second tool adapted for manipulating the opening mechanism of locked doors having lever type handles.

20. The tool kit according to claim 19, wherein said second tool comprises:

a tube portion having a straight section and a curved section;

an actuator potion comprising a spring wire having a first end attached to an outside surface of the straight section of said tube potion and a second end passing through the tube portion and a handle attached to the tube portion at an end of the curved section, wherein said spring wire forms a loop; and a knob attached to said second end of said spring wire.

* * * * *